US006419415B1

(12) United States Patent
Vosbikian et al.

(10) Patent No.: US 6,419,415 B1
(45) Date of Patent: Jul. 16, 2002

(54) FLUID DISTRIBUTION APPLIANCE

(75) Inventors: Peter S. Vosbikian, Moorestown; Robert E. Petner, Burlington, both of NJ (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 0 days.

(21) Appl. No.: 09/823,961

(22) Filed: Mar. 29, 2001

(51) Int. Cl.[7] ..... A46B 11/06

(52) U.S. Cl. ..... 401/289; 401/139; 401/137; 401/25; 401/16

(58) Field of Search ..... 401/289, 270, 401/282, 284, 285, 140, 138, 137, 25, 16, 139

(56) References Cited

U.S. PATENT DOCUMENTS

| | | | | |
|---|---|---|---|---|
| 403,625 A | * | 5/1889 | Thompson | 401/139 |
| 954,542 A | | 5/1910 | Raymond et al. | |
| 1,968,827 A | | 8/1934 | Grewe | |
| 2,304,003 A | | 12/1942 | Logan | |
| 2,935,754 A | | 5/1960 | Abdo | |
| 4,095,746 A | | 6/1978 | Anderberg et al. | |

FOREIGN PATENT DOCUMENTS

| | | |
|---|---|---|
| CA | 1162364 | 2/1984 |
| GB | 2096888 | 3/1982 |

* cited by examiner

*Primary Examiner*—David J. Walczak
(74) *Attorney, Agent, or Firm*—Stuart M. Goldstein

(57) ABSTRACT

A fluid distribution appliance comprises a manifold unit integrally formed with top, side, front and back walls, and a bottom surface, and a handle receiving section. The walls and bottom surface of the manifold form an enclosed space, through which fluid flows and is delivered through nozzles located at one of the front walls of the manifold. The manifold also supports a squeegee made of a layer of semi-rigid material, which is secured to the manifold by a holddown plate and screws. A triangular brace support is secured at one end to a handle attached to a handle receiving section of the manifold and, at its other two ends, to the manifold. The manifold, with its brace and handle, can be used independently or in combination with a bristle push broom head which is configured to receive the manifold in fitted, surface to surface contact.

15 Claims, 5 Drawing Sheets

FLUID DISTRIBUTION APPLIANCE

BACKGROUND OF THE INVENTION

The use of push brooms for sweeping dry surfaces is well known. However, there are relatively few practical devices which contemplate that use of a bristle push broom or combination with a fluid distribution system, to assist in the cleaning operation. And there are no devices which offer a fluid distribution water manifold which can be used independently and in combination with a bristle push broom head.

Devices, such as are shown in U.S. Pat. No. 4,095,746, are cleaning tools consisting simply of piping which downwardly directs sprayed fluid. Such does not disclose the use of a bristle push broom. Push brooms which employ the use of fluid, such as are disclosed in U.S. Pat. Nos. 954,542 and 2,304,003, expel fluid from an outside source randomly and directly through the brooms' bristles. There is no means for controlling the flow of fluid within the base of the broom head or for directing fluid ahead of the broom head—which is desired in many cleaning applications. No prior devices employ the use of a separate manifold unit which can be used independently for the distribution and delivery of fluid, or in tandem with a push broom head, as is contemplated by the present invention.

SUMMARY OF THE INVENTION

It is thus the object of the present invention to overcome the limitations and disadvantages of prior water distribution appliances.

It is an object of the present invention to provide a fluid distribution appliance which effectively and efficiently provides for sweeping and wet cleaning of surfaces with one compact cleaning tool.

It is a further object of the present invention to provide a fluid distribution appliance which can employ the use of a bristle push broom head in combination with an independently attachable manifold unit.

It is another object of the present invention to provide a fluid distribution appliance with a manifold unit with forwardly directed nozzles.

It is a further object of the present invention to provide a fluid distribution appliance with a manifold unit which can be operated separately from and independently of a push broom head.

It is still another object of the present invention to provide fluid distribution appliance with a manifold unit with a brace component which serves to support the handle of the appliance.

It is another object of the present invention to provide a fluid distribution appliance with means for positioning a fluid removal means, like a squeegee blade, on the manifold unit to assist in the cleaning operation.

It is still another object of the present invention to provide a fluid distribution appliance which comprises an integrally molded manifold unit which can simply and economically be manufactured to be used independently or in combination with a push broom head.

The present invention discloses a fluid distribution appliance comprising a manifold unit integrally formed with top, side, front and back walls, and a bottom surface, and a handle receiving section. The walls and bottom surface of the manifold form an enclosed space, through which fluid flows and is delivered through nozzles located at one of the front walls of the manifold. The manifold also supports a squeegee made of a layer of semi-rigid material, which is secured to the manifold by a holddown plate and screws. A triangular brace support is secured at one end to a handle attached to a handle receiving section of the manifold and, at its other two ends, to the manifold. The manifold, with its brace and handle, can be used independently or in combination with a bristle push broom head which is configured to receive the manifold in fitted, surface to surface contact.

The novel features which are considered as characteristic of the invention are set forth in particular in the appended claims. The fluid distribution appliances itself, however, as to its design, construction, and use, together with additional features and advantages thereof, are best understood upon review of the following detailed description with reference to the accompanying drawings.

DETAILED DESCRIPTION OF THE INVENTION

Figure 1:
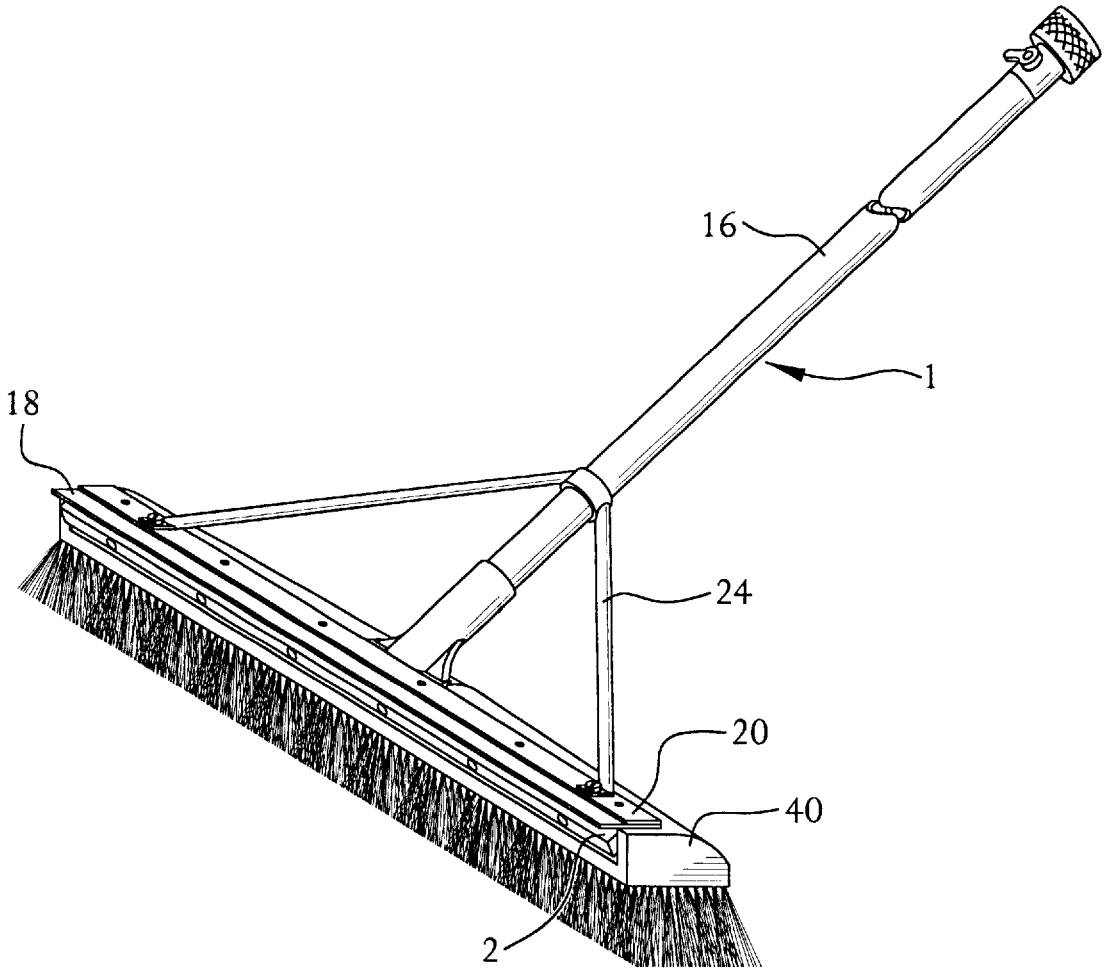
FIG. 1 is a perspective view of the fluid distribution appliance of the present invention with its manifold and broom head attached.
Figure 2:
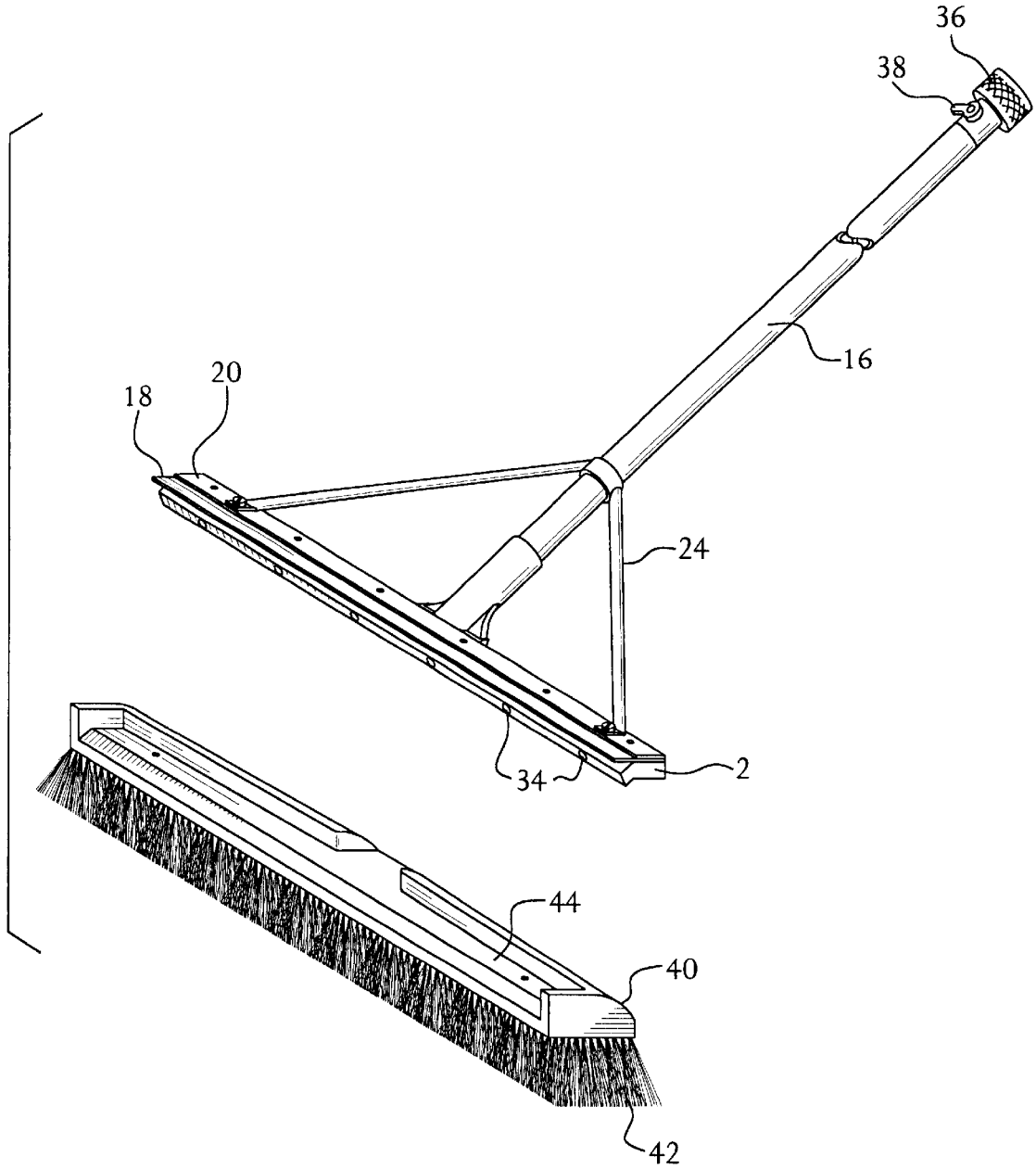
FIG. 2 is a perspective view of the fluid distribution appliance of the present invention showing separation between the manifold and broom head.

An integral component of fluid distribution appliance 1 of the present invention is manifold 2, comprising a top wall 6, sidewalls 7 and 8, front walls 9 and 10, back wall 11, and bottom surface 12. While manifold 2 may be manufactured by other means and with separable components, it is currently contemplated that the manifold will be manufactured as an integral molded, unitary body, preferably of plastic material. It can be appreciated that walls 6–11 and bottom surface 12 of manifold 2 form an enclosed space within the manifold. Nozzles 34 are permanently set within front wall 10 of manifold 2 to allow fluid to flow forwardly of the manifold.

A handle receiving component 14 is secured to manifold 2 and also may be integrally formed from the manifold. Handle receiving component 14 is configured to receive handle 16 by threaded connection, known in the art. Handle 16 is hollow in configuration. The upper end of handle 16 has threaded connection 36 for receiving water or other cleaning fluid, under pressure, from an outside source. Fluid control switch 38 controls the flow of fluid through handle 16.

Thus, manifold 2, with handle 16, can be used independently to distribute and deliver fluid, under pressure, through nozzles 34, to a surface to be cleaned or otherwise wetted down with fluid.

Figure 3:
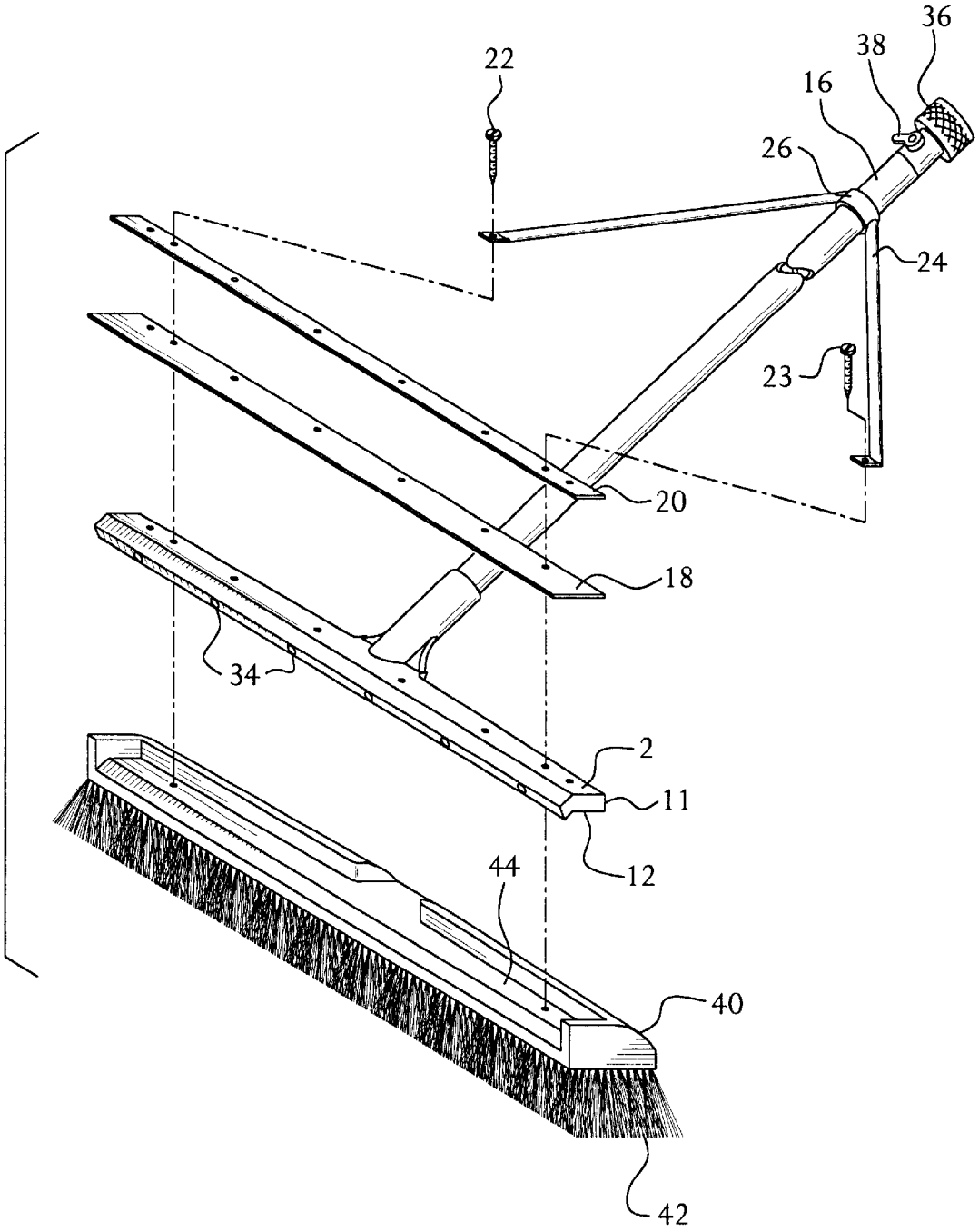
FIG. 3 is an exploded perspective view of the fluid distribution appliance of the present invention showing its separate components.
Figure 4:
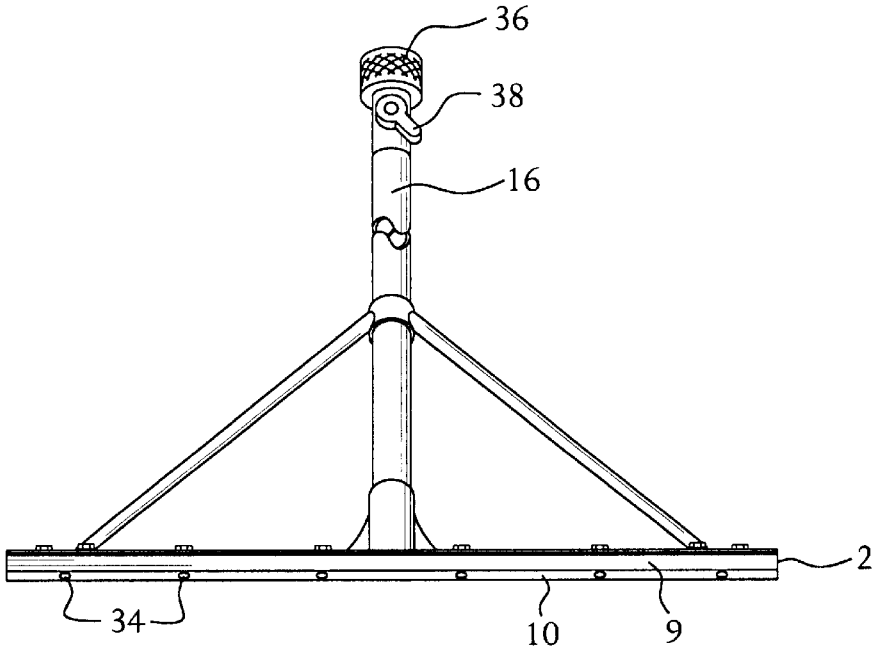
FIG. 4 is a front view of the manifold of the fluid distribution appliance of the present invention, with handle attached.
Figure 5:
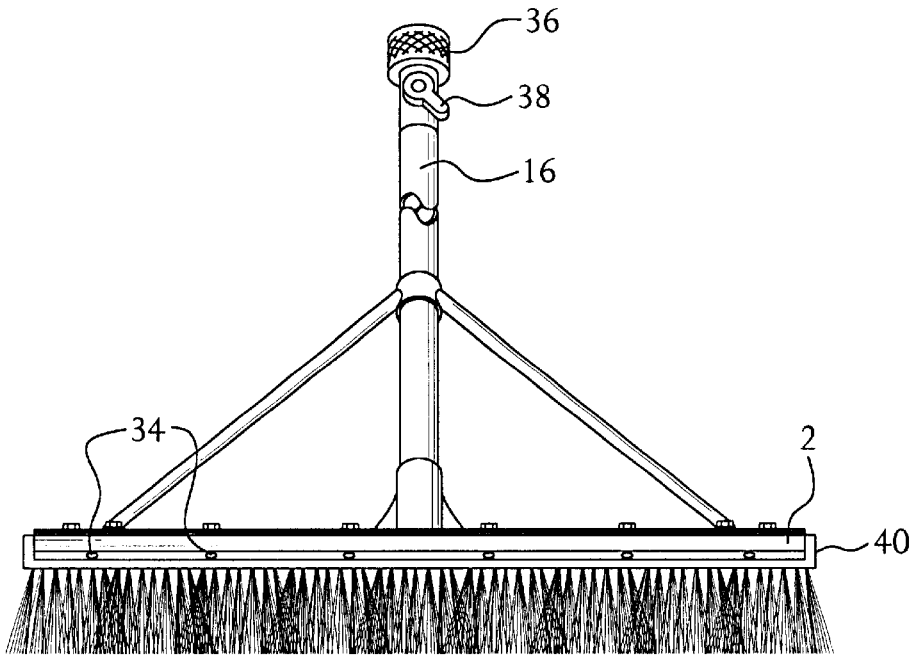
FIG. 5 is a front view of the manifold in place on the broom head of the fluid distribution appliance of the present invention.
Figure 6:
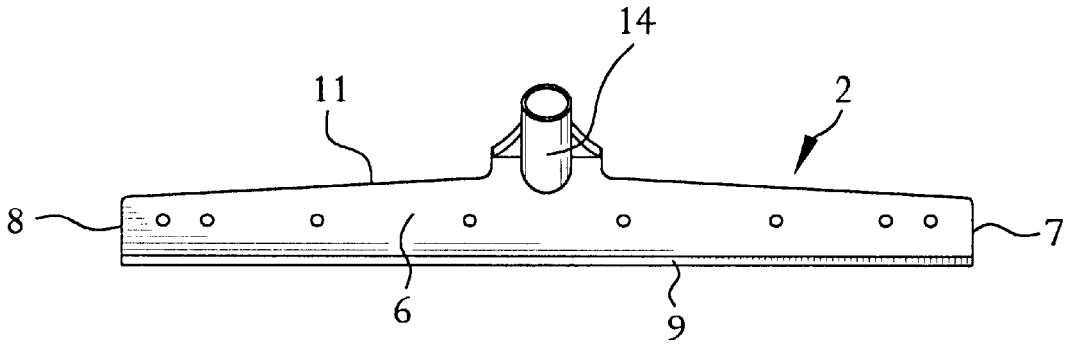
FIG. 6 is a top view of the manifold of the fluid distribution appliance of the present invention.
Figure 7:
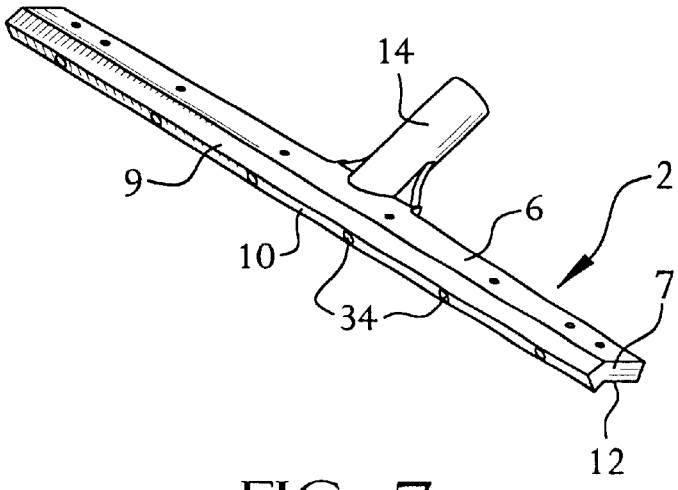
FIG. 7 is a perspective view of the manifold of the fluid distribution appliance of the present invention.

A semi-rigid squeegee 18, which could be made of hard rubber or similar material, is positioned over manifold 2, on top wall 6. Squeegee 18 extends slightly forward of manifold 2, to provide a means to squeezingly remove fluid when squeegee 18 is utilized over a wet surface. Holddown plate 20, secured by screws 22 and 23, maintains squeegee 18 in place on manifold 2. Brace 24 is provided to maintain handle 16 in position. Brace 24 is secured to handle 16 at its upper end 26 and is secured to manifold 2, by screws 22 and 23, at its two lower ends, which rest on holddown plate 20, as is best seen in FIG. 3.

Manifold 2, with handle 16, can be used in combination with push broom head 40. Broom head 40 comprises broom block 41 with upper planar surfaces 43 and lower planar surface 45 to which broom bristles 42 are secured, as is known in the art. Broom block 41 comprises a cutout section 44 comprising cutout surface 46 and adjoining surfaces 47 and 48. Surfaces 46, 47, and 48 form exterior surfaces of broom block 41. Manifold 2 is configured to be positioned and fitted within cutout section 44 by means of a surface to surface contact between bottom surface 12 and back wall 11 of manifold 2 and cutout surface 46 and adjoining surfaces 47 and 48 of cutout 44, as best seen in FIG. 3. Manifold 2, with squeegee 18 and hold down plate 20, are then secured to broom head 40 by screws 22 and 23 of appropriate length. When manifold 2 is in place on cutout section 44, upper surfaces 43 of broom block 41 are substantially co-planar to the top surface of manifold 2, as best seen in FIG. 1.

By this configuration, manifold 2 can advantageously be used in combination with broom head 40 to provide a wet broom fluid distribution appliance. It can be appreciated that fluid is expelled, under pressure, from nozzles 34, ahead of broom head 40, as the push broom is being used, thus enhancing the effect of the wet broom appliance. Brace 24 continues to provide additional reinforcement and strength, to maintain handle 16 in position on manifold 2, secured to push broom head 40. Switch 38 controls when and the amount of the fluid which is discharged and squeegee 18 can again conveniently be used to squeezingly remove excess fluid from the cleaning surface.

Certain novel features and components of this invention are disclosed in detail in order to make the invention clear in at least one form thereof. However, it is to be clearly understood that the invention as disclosed, since it is apparent that various modifications and changes may be made without departing from the spirit of the invention.

We claim:

1. A wet broom comprising:

(a) broom head means for broom sweeping surfaces, said broom head means comprising a broom block with a planar lower surface and planar upper surfaces, the lower surface of the broom block supporting broom bristles, the broom block further comprising a section cutout from and inset within the block, the cutout section comprising a cutout surface below the planar upper surface of the block;

(b) a separate, removably attachable manifold, said manifold having a top surface and being substantially sized to be fitted and located within the cutout section of the broom block, on the cutout surface, the block itself being substantially sized to fittingly receive and support the manifold within the cutout section, the upper surfaces of the block being substantially co-planar with the top surface of the manifold, whereby one integral unit is formed when the manifold is positioned and fitted into the cutout section;

(c) nozzle means in the manifold for expelling fluid under pressure directly from the nozzle means to the sweeping surface which is located ahead of the broom head means;

(d) means to secure the manifold to the cutout section of the broom head; and (e) an elongated handle connected to the broom head, said handle providing fluid to the manifold.

2. The wet broom as in claim 1 in which the manifold and the broom head means are positioned and fitted by means of surface to surface contact between surfaces of the manifold means and the surfaces of the receiving section.

3. The wet broom as in claim 1 in which the manifold is integrally molded and comprises top, front, back and side walls, and a bottom surface which form a substantially enclosed space.

4. The wet broom of claim 1 further comprising means extending from the manifold for receiving and securing the handle.

5. The wet broom of claim 4 in which the means extending from the manifold is an integrally molded component of the manifold.

6. The wet broom of claim 1 further comprising fluid removal means attached to the manifold for squeezingly removing fluid from cleaning surfaces.

7. The wet broom of claim 6 in which the fluid removal means comprises a squeegee of semi-rigid material extending forwardly of and secured to the manifold.

8. The wet broom of claim 7 in which the squeegee is secured to the manifold by a holddown plate.

9. The wet broom of claim 6 in which the fluid removal means is attached to the manifold by a holddown plate.

10. The wet broom of claim 1 further comprising brace means for maintaining the handle in position in relation to the broom head means.

11. The wet broom of claim 10 in which the brace means is secured at one end to the handle and at a second end to the manifold.

12. The wet broom of claim 11 in which the brace means is secured to the manifold at two separate locations.

13. A wet broom comprising:

(a) a unitary manifold means for distributing fluid, said manifold means comprising a planar top wall, a front wall located at an angle to and below the planar top wall, back and side walls, and a bottom surface;

(b) nozzles set within the front wall of the manifold means;

(c) fluid removal means for squeezingly removing fluid from cleaning surfaces, said fluid removal means being located directly on and overlaying the planar top wall of the manifold means;

(d) means located directly on and overlaying the fluid removal means to secure the fluid removal means to the planar top wall;

(e) an elongated handle connected to the manifold means;

(f) means extending from the manifold means for receiving and securing the handle;

(g) a broom head with bristles, said manifold means being substantially sized to be fitted into and located within a receiving section of the broom head, which itself is substantially sized to fittingly receive and support the manifold means, whereby one integral unit is formed when the manifold means is positioned and fitted into the receiving section; and (h) means to secure the manifold means to the broom head.

14. The wet broom as in claim 13 further comprising brace means secured to the planar top wall and extending between the manifold means and a location on the handle in spaced relation to the manifold means.

15. A wet broom comprising:

(a) broom head means for broom sweeping surfaces, said broom head means comprising a broom block with a planar lower surface and planar upper surfaces, the lower surface of the broom block supporting broom bristles, the broom block further comprising a section cutout from and inset within the block, the cutout section comprising a cutout surface extending substantially the entire length of the top of the broom block and further comprising adjoining facing surfaces below the planar upper surface of the block, said cutout and adjoining surface forming exterior surfaces of the broom block;

(b) a separate, removably attachable manifold, said manifold having a top surface and being substantially sized to be fitted over the cutout section of the broom block, and the block itself being substantially sized to fittingly receive and support the manifold on the cutout section, whereby one integral unit is formed when the manifold is positioned and fitted on the cutout section;

(c) nozzle means in the manifold for expelling fluid under pressure directly from the nozzle means to the sweeping surface which is located ahead of the broom head means;

(d) means to secure the manifold to the cutout section of the broom head; and (e) an elongated handle connected to the broom head, said handle providing fluid to the manifold.

* * * * *